US010723140B2

(12) United States Patent
Hwang et al.

(10) Patent No.: US 10,723,140 B2
(45) Date of Patent: Jul. 28, 2020

(54) DECREMENTING A PRINTING FLUID-BASED ESTIMATE OF A NUMBER OF PAGES THAT CAN BE PRINTED ACCORDING TO DIFFERENT INTERVALS

(71) Applicant: Hewlett-Packard Development Company, L.P., Spring, TX (US)

(72) Inventors: Peter G Hwang, Vancouver, WA (US); David B Novak, Corvallis, OR (US); Melissa S Gedraitis, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/330,829

(22) PCT Filed: Sep. 8, 2016

(86) PCT No.: PCT/US2016/050768
§ 371 (c)(1),
(2) Date: Mar. 6, 2019

(87) PCT Pub. No.: WO2018/048406
PCT Pub. Date: Mar. 15, 2018

(65) Prior Publication Data

US 2019/0210378 A1 Jul. 11, 2019

(51) Int. Cl.
*B41J 2/175* (2006.01)
*B41J 3/46* (2006.01)
*B41J 29/393* (2006.01)

(52) U.S. Cl.
CPC ..... *B41J 3/46* (2013.01); *B41J 2/175* (2013.01); *B41J 2/17566* (2013.01); *B41J 29/393* (2013.01); *B41J 2002/17569* (2013.01)

(58) Field of Classification Search
CPC ..... B41J 2/175; B41J 2/17566; B41J 3/46
See application file for complete search history.

(56) References Cited

U.S. PATENT DOCUMENTS 5,802,420 A 9/1998 Garr et al.
6,863,364 B2 3/2005 Russell et al.
(Continued)

FOREIGN PATENT DOCUMENTS

CN 1199184 A 11/1998
CN 101149671 A 3/2008
(Continued)

OTHER PUBLICATIONS

Decker, F., How Does a Printer Know When It is Low on Toner?, 2013, http://smallbusiness.chron.com/ ~ 3 pages.

*Primary Examiner* — Jason S Uhlenhake
(74) *Attorney, Agent, or Firm* — Tong Rea Bentley & Kim LLC

(57) ABSTRACT

In one example, method includes displaying an estimate of the number of pages that can be printed from a total amount of printing fluid including a printing fluid supply and a printing fluid reserve. The estimate is decremented in amounts of a first interval, in response to a first sensor signal indicating that the printing fluid supply is not empty. The estimate is decremented in amounts of a second interval that is smaller than the first interval, in response to a second sensor signal indicating that the printing fluid supply is empty.

15 Claims, 4 Drawing Sheets

(56) References Cited

U.S. PATENT DOCUMENTS

| | | | | |
|---|---|---|---|---|
| 6,883,364 | B2 | 3/2005 | Russell et al. | |
| 7,747,180 | B2 | 6/2010 | Wittenauer et al. | |
| 9,110,423 | B1 | 8/2015 | Bartle | |
| 2005/0226642 | A1* | 10/2005 | Rodriguez | G03G 15/556 399/27 |
| 2011/0193901 | A1* | 8/2011 | Martinez | B41J 2/17566 347/7 |
| 2014/0105619 | A1* | 4/2014 | Elliott | G03G 15/556 399/24 |

FOREIGN PATENT DOCUMENTS

| | | | |
|---|---|---|---|
| CN | 102016784 | A | 4/2011 |
| CN | 104462931 | A | 3/2015 |
| DE | 10000583 | A1 | 11/2000 |
| GB | 2351945 | A | 1/2001 |
| JP | H0193254 | A | 4/1989 |
| JP | H1191136 | A | 4/1999 |
| JP | 2005186301 | A | 7/2005 |

* cited by examiner

DECREMENTING A PRINTING FLUID-BASED ESTIMATE OF A NUMBER OF PAGES THAT CAN BE PRINTED ACCORDING TO DIFFERENT INTERVALS

BACKGROUND

Modern printing systems, such as laser printers, print images on substrates using printing fluid (e.g., ink, toner, or the like). The printing fluid may be dispensed from a disposable or refillable cartridge which contains an amount of printing fluid sufficient to print a finite number of pages. When the printing fluid is used up, the printing system may not be able to print further pages until the cartridge is replaced or refilled. Thus, users of the printing system may find it helpful to know how many more pages the system is capable of printing, so that they can plan their print jobs and/or obtain replacement cartridges accordingly.

DETAILED DESCRIPTION

In one example, the present disclosure describes an apparatus, method, and non-transitory computer readable storage medium for displaying approximate pages remaining (APR) data with increasing precision. As discussed above, users of a printing system may find it helpful to know how many more pages the system is capable of printing before it runs out of printing fluid. For example, if a print job contains a greater number of pages than the printing system can print from the current supply of printing fluid, the user may wish to replace one or more printing fluid cartridges before sending the print job to the printing system. Many printing systems are capable of estimating the APR (i.e., the number of pages that can be printed from the current supply of printing fluid) for a cartridge. The APR may be estimated, for example, based on the number of drops of printing fluid contained in the cartridge. These estimates can, in turn, be displayed in a way that is visible to users.

In order for the estimates to be useful, however, a certain degree of precision is desired at certain times. For example, when the cartridge is relatively fresh, and the printer can print 10,000 pages or more from the current printing fluid supply, users may not desire a high degree of precision (e.g., it may be enough to simply know that the APR is well in excess of their print job). However, when the cartridge is approaching empty, a higher degree of precision may be more useful (e.g., it may be helpful to know that the limited amount of printing fluid remaining is enough to complete a given print job). If the estimated APR is not precise enough to assure a user that his print job can be completed, he may be inclined to replace or refill the cartridge before it is actually empty, thereby wasting money and usable printing fluid.

Examples of the present disclosure display approximate pages remaining data with increasing precision as the total amount of available printing fluid decreases. In one example, when a sensor detects that print jobs are currently being printed from a reserve of printing fluid rather than from the printing fluid supply of the cartridge, the displayed APR begins to count down the number of pages remaining in smaller intervals than previously used. Thus, when there is less available printing fluid, the displayed APR becomes more precise. This allows users to better gauge whether their print jobs can be completed before the printing system runs out of printing fluid.

Figure 1:
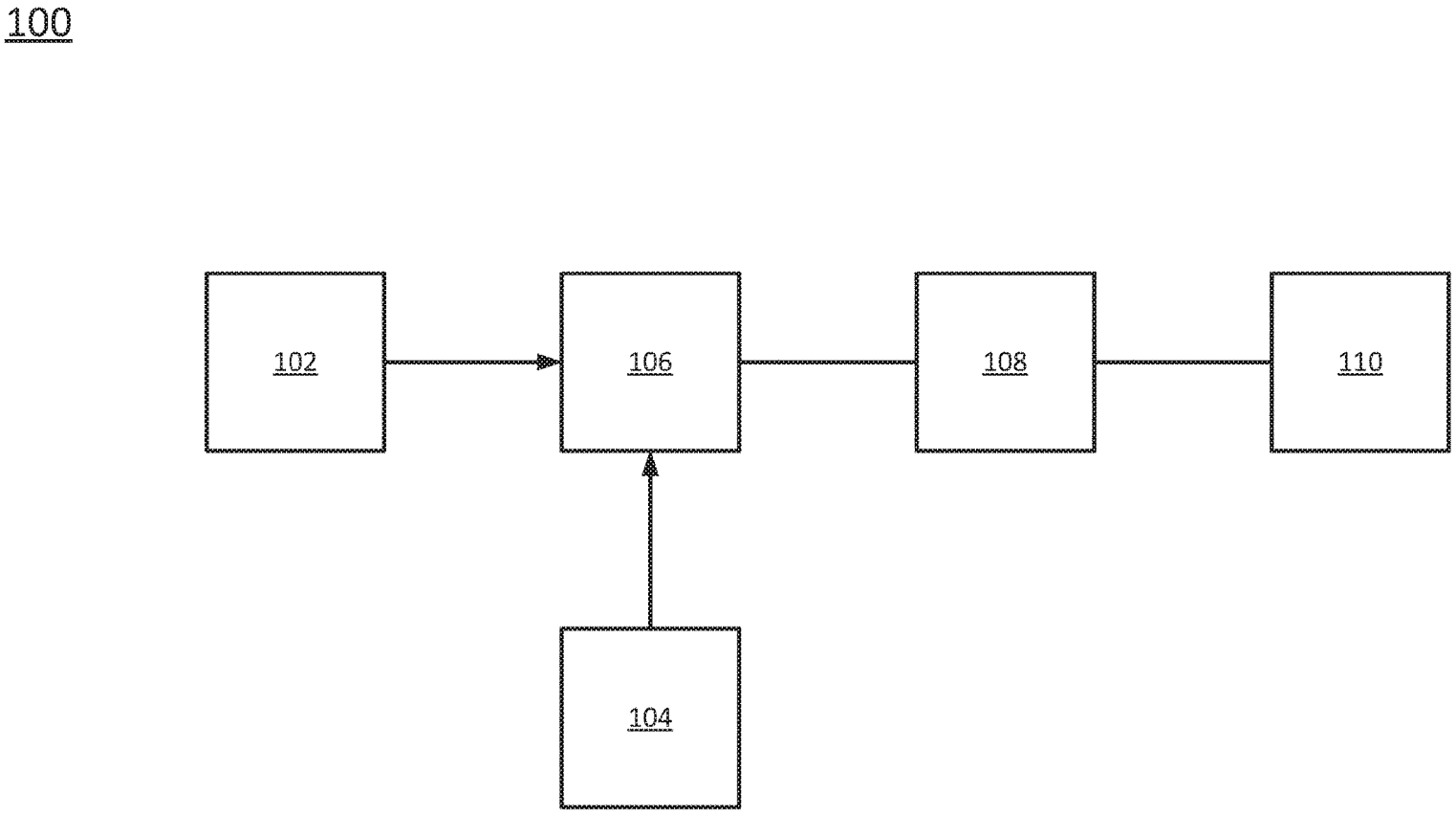
FIG. 1 is a schematic diagram illustrating a portion of one example of a printing system of the present disclosure.

FIG. 1 is a schematic diagram illustrating a portion of one example of a printing system 100 of the present disclosure. The system 100 is configured to print images on substrates (e.g., paper) using printing fluid (e.g., ink, toner, or the like). For instance, in one example, the printing system 100 is a laser printer. In one example, the system 100 includes a printing fluid supply 102, printing fluid reserve 104, a sensor 106, a processor 108, and a display 110.

In one example, the printing fluid supply 102 comprises a disposable or refillable supply of printing fluid, such as a cartridge filled with a finite amount of printing fluid. The number of pages that can be printed from the printing fluid supply 102 can be estimated based on the number of drops of printing fluid in the supply.

The printing fluid reserve 104 also comprises a finite amount of printing fluid. In one example, the amount of printing fluid in the printing fluid reserve 104 when full is less than the amount of printing fluid in the printing fluid supply 102 when full. For instance, in one example, the printing fluid reserve 104 when full contains enough printing fluid to print approximately 500 pages, whereas the printing fluid supply 102 when full may contain enough printing fluid to print 10,000 pages or more.

The sensor 106 is configured to detect when the printing fluid supply 102 is empty. In one example, the sensor 106 may be configured to detect this through a measure of a resistance, a capacitance, or an inductance between two pins that are in contact with the printing fluid in the printing fluid supply 102.

The processor 108 is configured to generate an estimate of the APR, based on the total amount of available printing fluid. In one example, the total amount of available printing fluid includes both the printing fluid in the printing fluid supply 102 and the printing fluid in the printing fluid reserve 104. In one example, discussed in further detail in connection with FIG. 2, the processor 108 increases the precision with which the APR is estimated when it receives a signal from the sensor 106 indicating that the printing fluid supply 102 is empty (e.g., which, in turn, indicates that jobs are currently being printed from the printing fluid reserve 104). The processor 108 may be configured as discussed below in connection with FIG. 4.

The display 110 is configured to receive signals from the processor 108. The signals contain data indicating the current APR of the system 100. In one example, the display 110 is a local display of the printing system 100 (e.g., a display that is built into the printing system 100). In another example, the display 110 is a remote display on a device that is communicatively coupled to the printing system 100 (e.g., the monitor of a remote computing device that is communicatively coupled to the printing system 100 over a network).

Figure 2:
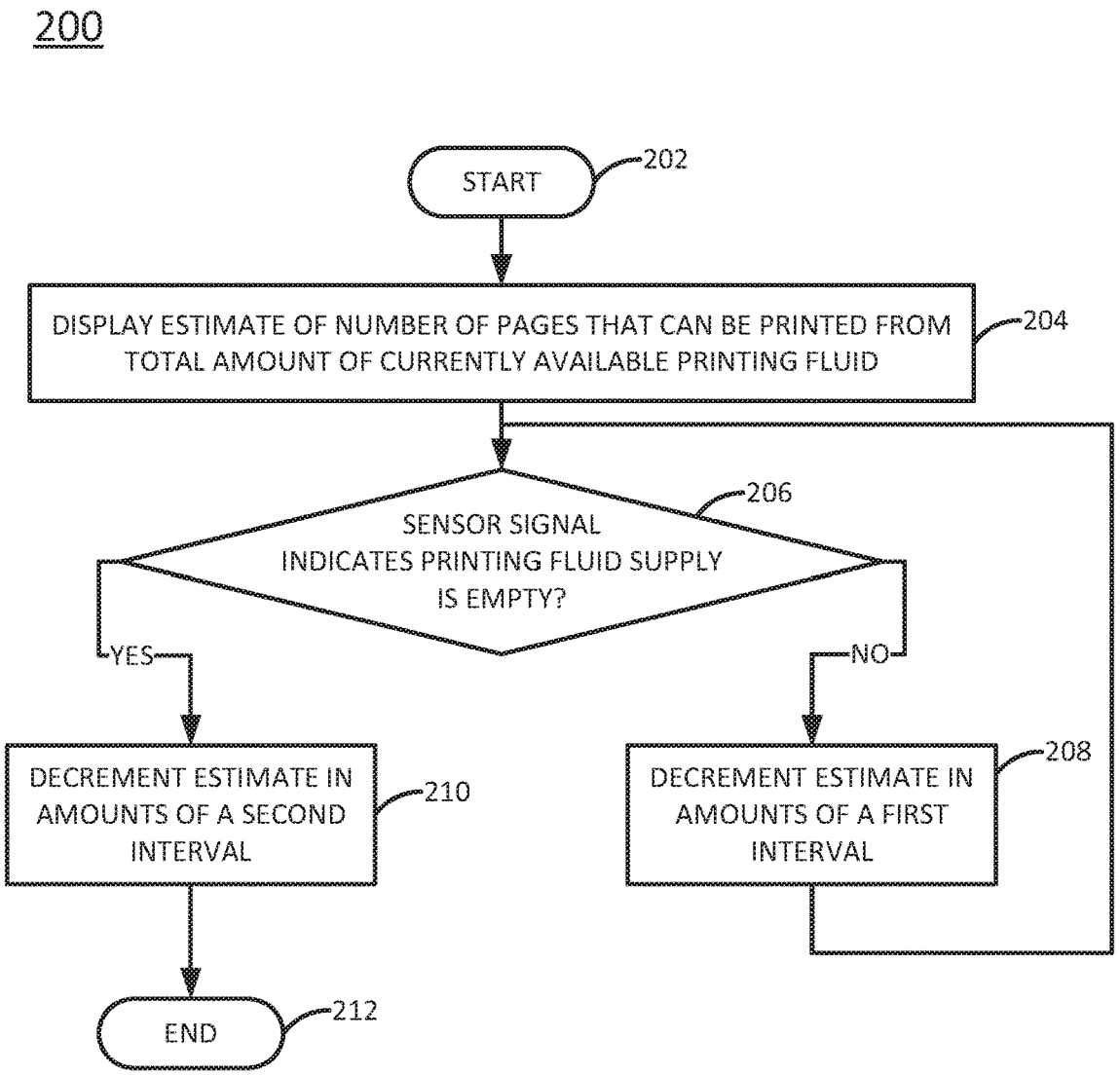
FIG. 2 illustrates a flowchart of a first example method for displaying an approximate pages remaining indicator.

FIG. 2 illustrates a flowchart of a first example method 200 for displaying an approximate pages remaining indicator. The method 200 may be performed, for example, by the printing system 100 of FIG. 1. Alternatively, or in addition, at least one of the blocks of the method 200 may be implemented by a computing device having a processor, a memory, and input/output devices as illustrated below in FIG. 4, specifically programmed to perform the blocks of the method 200, e.g., by operating as a control circuit for the printing system 100. Although a computing device may be specifically programmed to perform various blocks of the method 200, the method 200 is described in terms of an example where blocks of the method 200 are performed by a printing system, such as the printing system 100 of FIG. 1.

The method 200 begins in block 202. In block 204, the display 110 displays an estimate of the number of pages that can be printed from the total amount of currently available printing fluid in the printing system 100 (i.e., the printing fluid currently contained in the printing fluid supply 102 plus the printing fluid currently contained in the printing fluid reserve 104).

In block 206, processor 108 determines whether it has received a signal from the sensor 106 indicating that the printing fluid supply 102 is empty. If the processor concludes in block 206 that it has not received a signal from the sensor 106 indicating that the printing fluid supply 102 is empty, then the method continues to block 208.

In block 208, the display 110 decrements the estimate of the number of pages remaining in amounts of a first interval. In one example, the first interval may be an interval of 1,000. Thus, the display 110 displays the estimated number of pages remaining rounded to the nearest 1,000 pages, and decreases the displayed estimate every time another 1,000 pages are printed. For instance, the display 110 may display an estimate of 9,000 pages remaining. Once approximately 1,000 pages are printed, the display will change the displayed estimate to 8,000 pages remaining, and so on. The method 200 then returns to block 206, and the processor 108 continues to wait for a signal from the sensor 106.

If, on the other hand, the processor concludes in block 206 that it has received a signal from the sensor 106 indicating that the printing fluid supply 102 is empty, then the method continues to block 210.

In block 210, the display 110 decrements the estimate of the number of pages remaining in amounts of a second interval that is smaller than the first interval. In one example, the second interval is one-tenth or one-twentieth the size of the first interval. For example, if the first interval is an interval of 1,000, the second interval may be an interval of 100 or 50. Thus, the display 110 displays the estimated number of pages remaining rounded to the nearest 100 pages, and decreases the displayed estimate every time another 100 pages are printed. For instance, the display 110 may display an estimate of 500 pages remaining. Once approximately 100 pages are printed, the display will change the displayed estimate to 400 pages remaining, and so on.

The method 200 ends in block 212. The printing system 100 may continue to process print jobs after block 210 is performed, until the printing system 100 runs out of printing fluid or until a user halts the printing system 100 in order to replenish the printing fluid (e.g., by replacing one or more cartridges).

Figure 3:
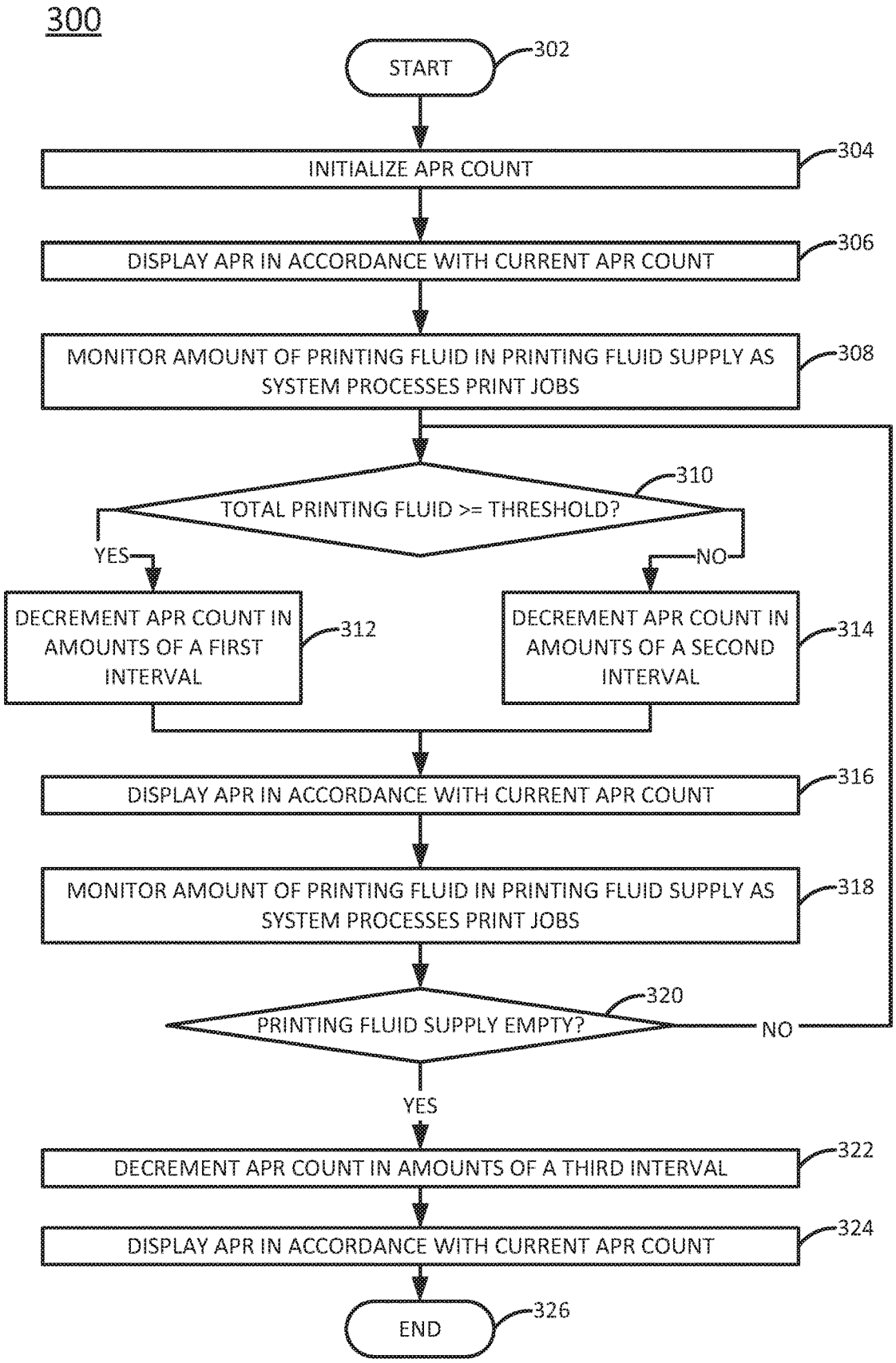
FIG. 3 illustrates a flowchart of a second example method for displaying an approximate pages remaining indicator.

FIG. 3 illustrates a flowchart of a second example method 300 for displaying an approximate pages remaining indicator. In particular, the method 300 presents a more detailed implementation of the method 200 discussed above. Thus, the method 300 may also be performed, for example, by the printing system 100 of FIG. 1. Alternatively, or in addition, at least one of the blocks of the method 300 may be implemented by a computing device having a processor, a memory, and input/output devices as illustrated below in FIG. 4, specifically programmed to perform the blocks of the method 300, e.g., by operating as a control circuit for the printing system 100. Although a computing device may be specifically programmed to perform various blocks of the method 300, the method 300 will now be described in terms of an example where blocks of the method 300 are performed by a printing system, such as the printing system 100 of FIG. 1.

The method 300 begins in block 302. In block 304, the processor initializes an approximate pages remaining (APR) count. The APR count is based on the total amount of printing fluid (e.g., number of drops) currently available to the printing system 100, which in one example is the sum of the printing fluid in the printing fluid supply 102 and the printing fluid in the printing fluid reserve 104. Thus, when the printing fluid supply 102 is full (e.g., when a new cartridge has just been installed), the APR count may be very large (e.g., 10,000 pages or more).

In block 306, the display 110 displays the APR in accordance with the current APR count. As discussed above, the display 110 may be a local display of the printing system 100 (e.g., a display that is built into the printing system 100) or a remote display on a device that is communicatively coupled to the printing system 100 (e.g., the monitor of a remote computing device that is communicatively coupled to the printing system 100 over a network).

In block 308, the processor 108 monitors the amount of printing fluid in the printing fluid supply 102 as the printing system 100 processes print jobs. That is, as the printing system 100 processes print jobs, the amount of printing fluid in the printing fluid supply 102 will gradually decrease. The processor 108 may receive signals from the sensor 106, from which the amount of printing fluid in the printing fluid supply 102 can be determined.

In block 310, the processor 108 determines whether the total amount of available printing fluid (i.e., the amount of printing fluid in the printing fluid supply 102, as indicated by the sensor 106, plus the amount of printing fluid in the printing fluid reserve 106) is at least as much as a predefined threshold amount of printing fluid. In one example, the predefined threshold is a certain percentage (e.g., 20%) of the total amount of available printing fluid when the printing fluid supply 102 is full (e.g., the amount on which the initialized APR count is based in block 304). In another example, the predefined threshold is a certain number of pages (e.g., 4,000) that can be printed from the total amount of available printing fluid.

If the total amount of available printing fluid is determined in block 310 to be at least as much as the predefined threshold, then the method 300 proceeds to block 312. In block 312, the processor decrements the APR count in amounts of a first interval as the printing system continues to process print jobs. In one example, the first interval may be an interval of 1,000. Thus, the APR count may be rounded to the nearest 1,000 pages, and decrease every time another 1,000 pages are printed. For instance, the APR may hold steady for a time at an estimate of 9,000 pages remaining. Once approximately 1,000 pages are printed, the APR count will change to 8,000 pages remaining, and so on.

If, on the other hand, the total amount of available printing fluid is determined in block 310 to be less than the predefined threshold, then the method 300 proceeds to block 314. In block 314, the processor decrements the APR count in amounts of a second interval as the printing system continues to process print jobs. In one example, the second interval is the same as the first interval (e.g., every 1,000 pages printed). In another example, however, the second interval is different from the first interval.

As the APR count is decremented in amounts according to the appropriate interval (e.g., in accordance with either block 312 or block 314), the method 300 proceeds to block 316. In block 316, the display 110 displays the APR in accordance with the current APR count.

In block 318, the processor 108 continues to monitor the amount of printing fluid in the printing fluid supply 102 as the printing system 100 processes print jobs.

In block 320, the processor 108 determines whether the printing fluid supply 102 is empty. As discussed above, the processor 108 may receive signals from the sensor 106, from which the amount of printing fluid in the printing fluid supply 102 can be determined.

If the processor 108 concludes in block 320 that the printing fluid supply 102 is not empty, then the method 300 returns to block 310 and proceeds as described above.

However, if the processor 108 concludes in block 320 that the printing fluid supply 102 is empty, then the method 300 proceeds to block 322. In block 322, the processor decrements the APR count in amounts of a third interval as the printing system continues to process print jobs. In one example, the third interval is smaller than the first interval and the second interval. In one example, the third interval may be an interval of 100 or 50. Thus, the APR count may be rounded to the nearest 100 pages, and decrease every time another 100 pages are printed. For instance, the APR may hold steady for a time at an estimate of 500 pages remaining. Once approximately 100 pages are printed, the APR count will change to 400 pages remaining, and so on.

In block 324, the display 110 displays the APR in accordance with the current APR count. In one example, once the APR counts drops to 100, the display 110 will display "<100."

The method 300 ends in block 326. The printing system 100 may continue to process print jobs after block 326 is performed, until the printing system 100 runs out of printing fluid or until a user halts the printing system 100 in order to replenish the printing fluid (e.g., by replacing one or more cartridges).

Figure 4:
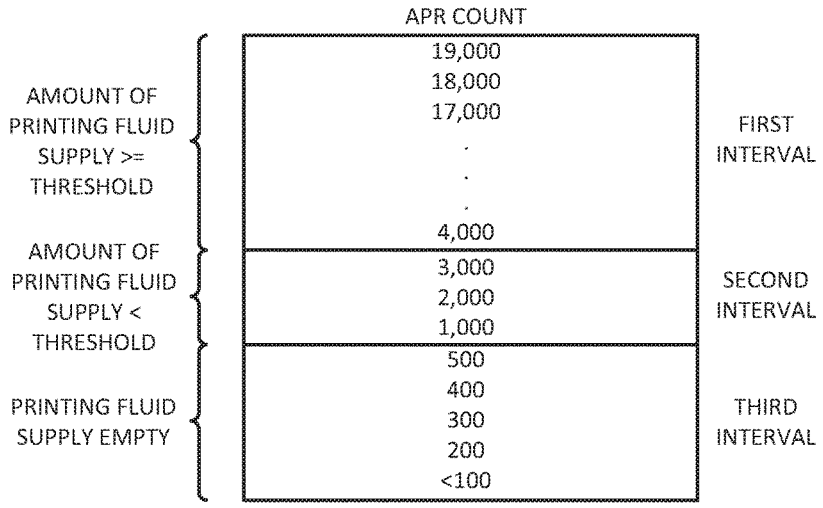
FIG. 4 is a graphic summarizing the method of FIG. 3.

FIG. 4 is a graphic summarizing the method 300 of FIG. 3. FIG. 4 uses example numbers for the APR count and for the first, second, and third intervals; however, these numbers are not meant to be limiting.

As illustrated, the APR count counts down in 1,000 page decrements (e.g., a first interval) when the amount of printing fluid in the printing fluid supply is at least as great as a predefined threshold (e.g., enough to print 4,000 pages in the example of FIG. 4). Thus, in the example range of 4,000 to 19,000 pages, the displayed APR decreases in intervals of 1,000 pages. This provides an estimate of the number of pages remaining with a fair amount of precision, but without implying that the APR is more precise than it is. In this range of 4,000 to 19,000 pages, a more precise APR may be of limited use to users anyway, unless they are trying to print exceptionally large print jobs.

When the amount of printing fluid in the printing fluid supply falls below the predefined threshold, the APR continues to count down in 1,000 page decrements (e.g., a second interval).

When the printing fluid supply is empty (i.e., the printing system begins printing from the printing fluid reserve), the APR count begins to count down in 100 page decrements (e.g., a third interval). Thus, in the example range of 500 to zero pages, the displayed APR decreases in intervals of 100 pages. This provides an estimate of the number of pages remaining with an improved amount of precision. This improved precision may be helpful to users trying to print relatively large print jobs, who want assurance that their print job can be completed without replenishing the printing fluid supply (e.g., if a user wants to print a 50 page print job, knowing that approximately 200 pages remain is helpful). By contrast, displaying a less precise APR at this stage (e.g., "less than 500 pages remaining") may be of less help, since it covers a potentially large range that may or may not be enough for a given print job to complete (e.g., the 50 page print job may not be possible, since "less than 500" could be 200 pages, or it could be 20 pages).

The change in displayed APR when transitioning from the second interval to the first interval may vary. For instance, the displayed APR could jump from 2,000 pages to 1,000 pages to 500 pages. Alternatively, the displayed APR could linger on 1,000 pages for a period of time or could jump directly from 2,000 pages to 500 pages, for example.

The displayed APR when decrementing after the printing fluid supply 102 is exhausted (i.e., according to the second interval in the method 200 or the third interval in the method 300) is approximate due to the variation in the density of the printing fluid on the print jobs to be processed, rather than due to uncertainty as to how much printing fluid is left (once the printing fluid reserve 104 is engaged). Thus, although the APR is approximate at this stage, it is fairly accurate since the amount of usable printing fluid remaining is known. Thus, the methods 200 and 300 can provide users with the number of pages the printing system 100 is capable of printing with relatively high precision, right down until approximately 100 pages or less remain.

It should be noted that although not explicitly specified, some of the blocks, functions, or operations of the methods 200 and 300 described above may include storing, displaying and/or outputting for a particular application. In other words, any data, records, fields, and/or intermediate results discussed in the methods can be stored, displayed, and/or outputted to another device depending on the particular application. Furthermore, blocks, functions, or operations in FIGS. 2 and 3 that recite a determining operation, or involve a decision, do not imply that both branches of the determining operation are practiced. In other words, one of the branches of the determining operation may not be performed, depending on the results of the determining operation.

Figure 5:
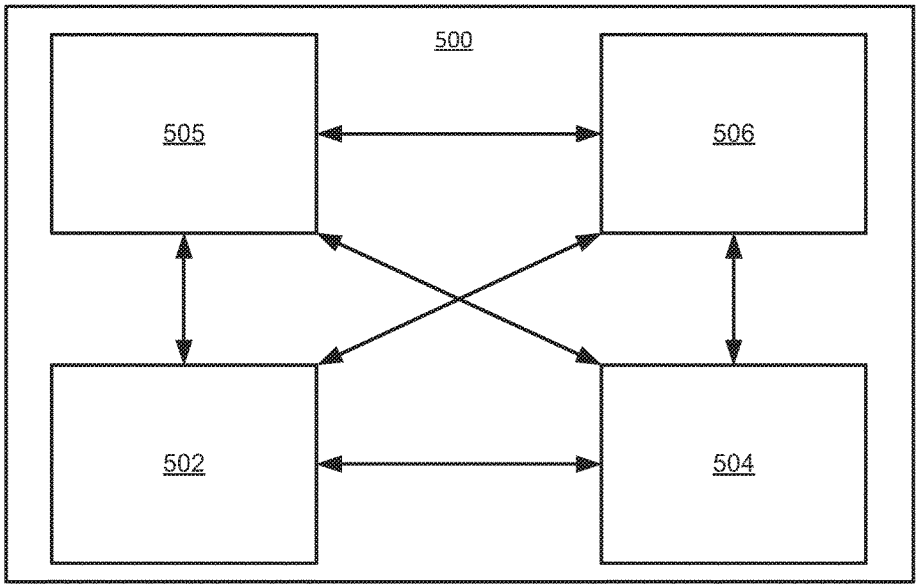
FIG. 5 depicts a high-level block diagram of a computing device suitable for use in performing the functions described herein.

FIG. 5 depicts a high-level block diagram of a computing device suitable for use in performing the functions described herein. As depicted in FIG. 5, the computing device 500 comprises a hardware processor element 502, e.g., a central processing unit (CPU), a microprocessor, or a multi-core processor, a memory 504, e.g., random access memory (RAM), a module 505 for displaying APR data, and various input/output devices 506, e.g., storage devices, including but not limited to, a tape drive, a floppy drive, a hard disk drive or a compact disk drive, a receiver, a transmitter, a speaker, a display, a speech synthesizer, an output port, an input port and a user input device, such as a keyboard, a keypad, a mouse, a microphone, and the like. Although one processor element is shown, it should be noted that the general-purpose computer may employ a plurality of processor elements. Furthermore, although one general-purpose computer is shown in the figure, if the method(s) as discussed above is implemented in a distributed or parallel manner for a particular illustrative example, i.e., the blocks of the above method(s) or the entire method(s) are implemented across multiple or parallel general-purpose computers, then the general-purpose computer of this figure is intended to represent each of those multiple general-purpose computers.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the blocks, functions and/or operations of the above disclosed methods.

In one example, instructions and data for the present APR displaying module or process 505, e.g., machine readable instructions, can be loaded into memory 504 and executed by hardware processor element 502 to implement the blocks, functions, or operations as discussed above in connection with the example methods 300 and 400. Furthermore, when a hardware processor executes instructions to perform "operations," this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present APR displaying module 505, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. Furthermore, the computer-readable storage device may comprise any physical device or devices that provide the ability to store information such as data and/or instructions to be accessed by a processor or a computing device such as a computer or an application server.

In further examples, the present APR displaying module or process 505 does not reside on the same level of the computing device 500 as the hardware processor element 502 and memory 504, but instead resides on a level under the hardware processor element 502 and memory 504. Thus, FIG. 5 depicts the computing device 500 at a high level, and other configurations of the hardware processor element 502, memory 504, APR displaying module or process 505, and I/O devices, including hierarchical configurations, are possible.

It will be appreciated that variants of the above-disclosed and other features and functions, or alternatives thereof, may be combined into many other different systems or applications. Various presently unforeseen or unanticipated alternatives, modifications, or variations therein may be subsequently made, which are also intended to be encompassed by the following claims.

What is claimed is:

1. A method, comprising:

displaying an estimate of a number of pages that can be printed from a total amount of printing fluid including a printing fluid supply and a printing fluid reserve;

decrementing the estimate in amounts of a first interval, in response to a first sensor signal indicating that the printing fluid supply is not empty; and decrementing the estimate in amounts of a second interval that is smaller than the first interval, in response to a second sensor signal indicating that the printing fluid supply is empty.

2. The method of claim 1, further comprising:

determining, in response to a third sensor signal received after the first sensor signal but before the second sensor signal, that the total amount of printing fluid is less than a predefined threshold amount; and decrementing the estimate in amounts of a third interval in response to the determining, after the decrementing the estimate in amounts of a first interval but before the decrementing the estimate in amounts of a second interval.

3. The method of the 2, wherein the third interval is equal to the first interval.

4. The method of claim 2, wherein the predefined threshold amount is specified as a percentage of the total amount of printing fluid as measured at a time when the printing fluid supply was full.

5. The method of claim 2, wherein the predefined threshold amount is specified as an estimated number of pages that can be printed from the total amount of printing fluid as measured at a time of the determining.

6. The method of claim 1, wherein the second interval is one-tenth a size of the first interval.

7. The method of claim 1, wherein the second interval is one-twentieth a size of the first interval.

8. A non-transitory machine-readable storage medium encoded with instructions executable by a processor, the machine-readable storage medium comprising:

instructions to display an estimate of a number of pages that can be printed from a total amount of printing fluid including a printing fluid supply and a printing fluid reserve;

instructions to decrement the estimate in amounts of a first interval, in response to a first sensor signal indicating that the printing fluid supply is not empty; and instructions to decrement the estimate in amounts of a second interval that is smaller than the first interval, in response to a second sensor signal indicating that the printing fluid supply is empty.

9. The non-transitory machine-readable storage medium of claim 8, further comprising:

instructions to determine, in response to a third sensor signal received after the first sensor signal but before the second sensor signal, that the total amount of printing fluid is less than a predefined threshold amount; and instructions to decrement the estimate in amounts of a third interval in response to the determining, after the decrementing the estimate in amounts of a first interval but before the decrementing the estimate in amounts of a second interval.

10. The non-transitory machine-readable storage medium of the 9, wherein the third interval is equal to the first interval.

11. The non-transitory machine-readable storage medium of claim 9, wherein the predefined threshold amount is specified as a percentage of the total amount of printing fluid as measured at a time when the printing fluid supply was full.

12. The non-transitory machine-readable storage medium of claim 9, wherein the predefined threshold amount is specified as an estimated number of pages that can be printed from the total amount of printing fluid as measured at a time of the determining.

13. The non-transitory machine-readable storage medium of claim 8, wherein the second interval is at most one-tenth a size of the first interval.

14. An apparatus, comprising:

a sensor to sense an amount of printing fluid contained in a printing fluid supply;

a processor to generate an estimate of a number of pages that can be printed from a total amount of printing fluid including the printing fluid contained in the printing fluid supply and printing fluid contained in a printing fluid reserve;

a display to display the estimate in a manner that decrements in amounts of a first interval, in response to a first signal from the sensor indicating that the printing fluid supply is not empty and that decrements in amounts of a second interval that is smaller than the first interval, in response to a second signal from the sensor indicating that the printing fluid supply is empty.

15. The apparatus of claim 14, wherein the display is a remote display communicatively coupled to the processor via a network.

* * * * *